United States Patent [19]

Baker

[11] 4,073,098

[45] * Feb. 14, 1978

[54] ROOFING SYSTEM FOR LARGE-AREA BUILDING STRUCTURES

[75] Inventor: William H. Baker, Rock Hill, S.C.

[73] Assignee: Paddock Industries, Inc., Boynton Beach, Fla.

[ * ] Notice: The portion of the term of this patent subsequent to Nov. 27, 1990, has been disclaimed.

[21] Appl. No.: 627,994

[22] Filed: Nov. 3, 1975

Related U.S. Application Data

[63] Continuation of Ser. No. 390,157, Aug. 20, 1973, abandoned, which is a continuation-in-part of Ser. No. 555,751, March 6, 1975, abandoned.

[51] Int. Cl.[2] ..... E04C 2/42; E04B 1/36

[52] U.S. Cl. ..... 52/66; 52/664; 52/665; 52/669

[58] Field of Search ..... 52/669, 664, 463, 665, 52/666

[56] References Cited

U.S. PATENT DOCUMENTS

| | | | |
|---|---|---|---|
| 2,931,468 | 4/1960 | Keller | 52/481 |
| 3,146,864 | 9/1964 | Nystrom | 52/643 |
| 3,157,251 | 11/1964 | Rasch | 52/643 X |
| 3,333,387 | 8/1967 | Deakins | 52/664 |
| 3,604,176 | 9/1971 | Campbell | 52/758 |
| 3,774,366 | 11/1973 | Baker | 52/669 |

*Primary Examiner*—John E. Murtagh

[57] ABSTRACT

A roofing system is provided for large-area wide-span building structures such as natatoria, comprising an interlocking gridwork of purlins supported on beams. A portion of the structure can be provided with a track, and another portion of the structure mounted on wheels movable along the track, so that one portion of the roof may be slid open or closed by movement along the track, so as to open the interior of the building structure to the atmosphere.

8 Claims, 4 Drawing Figures

ROOFING SYSTEM FOR LARGE-AREA BUILDING STRUCTURES

This is a continuation, of application Ser. No. 390,157 filed Aug. 20, 1973 which in turn is a continuation-in-part of Ser. No. 555,751 filed Mar. 6, 1975 both, now abandoned.

The design of building structures with a large interior open area poses serious roof support problems. If the roof can be supported only at the sides of the structure, a large number of closely spaced roofing supports are necessary. The limitations imposed on construction costs for simple enclosures such as natatoria militate against use of conventional supports, however. A light but strong and simple construction is needed, to keep construction costs to a minimum. Also, it is desirable that the building design be based on modular units, which can easily be assembled and erected for any size structure and roofing span.

Surprisingly, while modular unit wall and room structures have been proposed, roofing structures made of modular unit components especially adapted for wide roof spans without intermediate supports have not been available. The type of modular unit design employed in wall construction is not suitable, of course, for roofing structures. A strong and rigid load-supporting unit construction is needed, for a wide-span roof, to support the roof cover and resist bending or rupture under stress such as strong winds and the weight of water or snow. A wall or floor unit normally is not strong enough to withstand the stresses encountered in a roof, since it has a relatively short span, and can be affixed to a load-supporting frame, at close interval spacing. The free span distance over which a roofing structure must be self-supporting is, of course, considerably greater in the case of large interior area wide-span structures.

In accordance with the invention, a roofing system for large-interior building area building structures is provided, comprising an array of beam supports extending from one side to the other of the building structure, optionally arranged at an angle to the sides defining a roof peak; and an interlocking purlin gridwork supported thereon, each gridwork comprising an array of load-supporting purlins extending in one direction between the beam supports, and an array of purlin spacers extending between the load-supporting purlins, the purlin spacers being interlocked with the load-supporting purlins, and the load-supporting purlins being interlocked with the beam supports; and roofing skins attached on at least one side and preferably both sides of the purlin gridwork.

In a preferred embodiment, the purlin gridworks support a track along which moves a purlin gridwork mounted on wheels which travel along the track. In this way, one portion of the roof can be made to slide upon another portion, so as to open a portion of the interior of the building structure to the atmosphere.

A preferred embodiment of the invention is shown in the drawings, in which.

Figure 1:
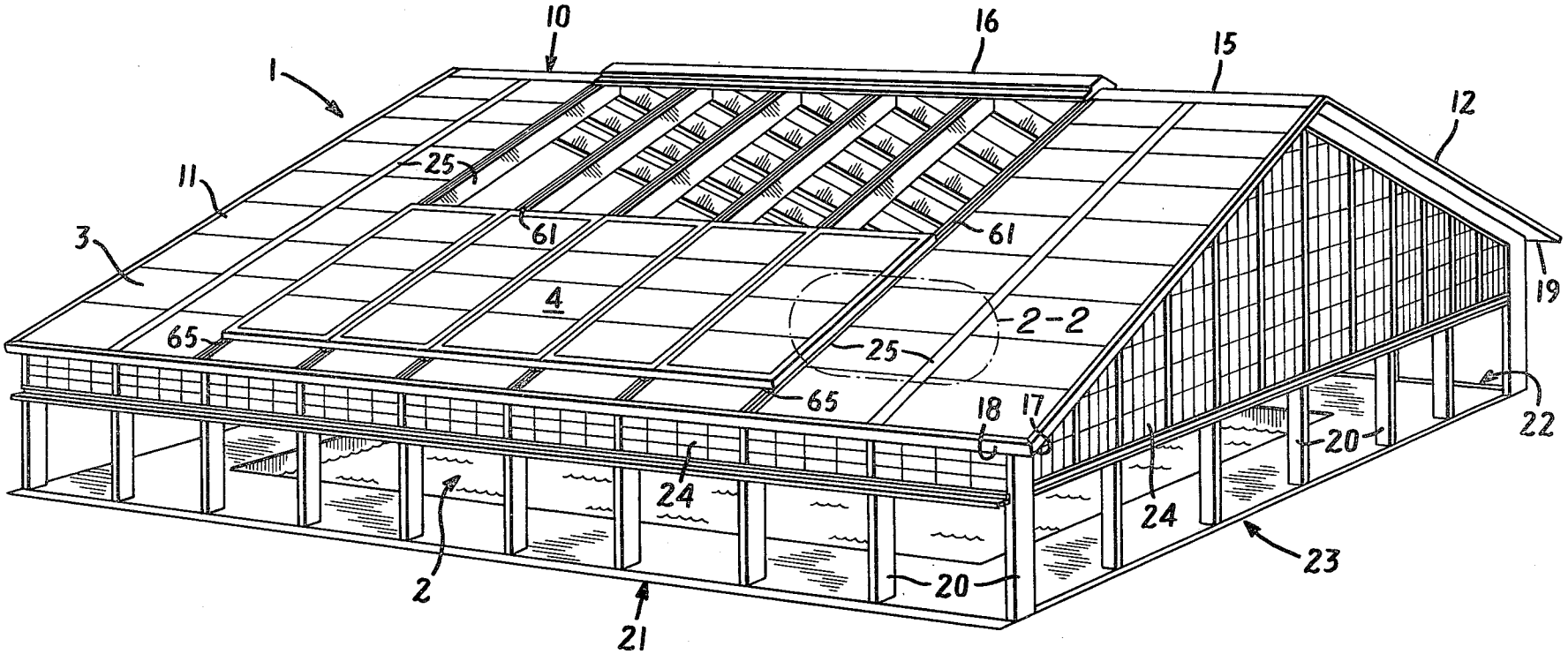
FIG. 1 represents a perspective view of a natatorium including a roofing system in accordance with the invention.

The building structure shown in FIG. 1 is a natatorium 1 enclosing a swimming pool 2, with a roof comprised of fixed roofing units 3 and movable roofing units 4, the roofing units 4 being movable either individually or as a group between closed and open positions, and shown in the open position, so as to open the swimming pool 2 to the atmosphere, under favorable weather conditions.

The building structure has a peaked roof 10, with two roof portions, 11, 12 meeting at an angle of 140° at the peak 15, topped by a decorative ridge beam 16. The edges 17 of the roof at the eaves 18, 19 are supported on a plurality of box beam columns 20, which run from the ground to the roof at the sides 21, 22 and the ends 23 of the structure 1. The upper portions of the sides and ends of the structure are partially enclosed by translucent fiber glass panels 24.

The roofing structure is supported on 10 box beams 25 on each side of the peak, each one extending from the peak to the side and end columns 20.

The fixed roofing units 3 and movable roofing units 4 have the roofing enclosure, the roof skins, carried on the purlin gridwork 30, and are arranged in rows between the box beams 25. These units span the spaces between the beams 25, and close off the top of the structure 1.

Each gridwork row 30 comprises a plurality of parallel evenly spaced load-supporting purlins 32, between which extend at right angles thereto a plurality of parallel evenly-spaced purlin spacers 33.

Figure 3:
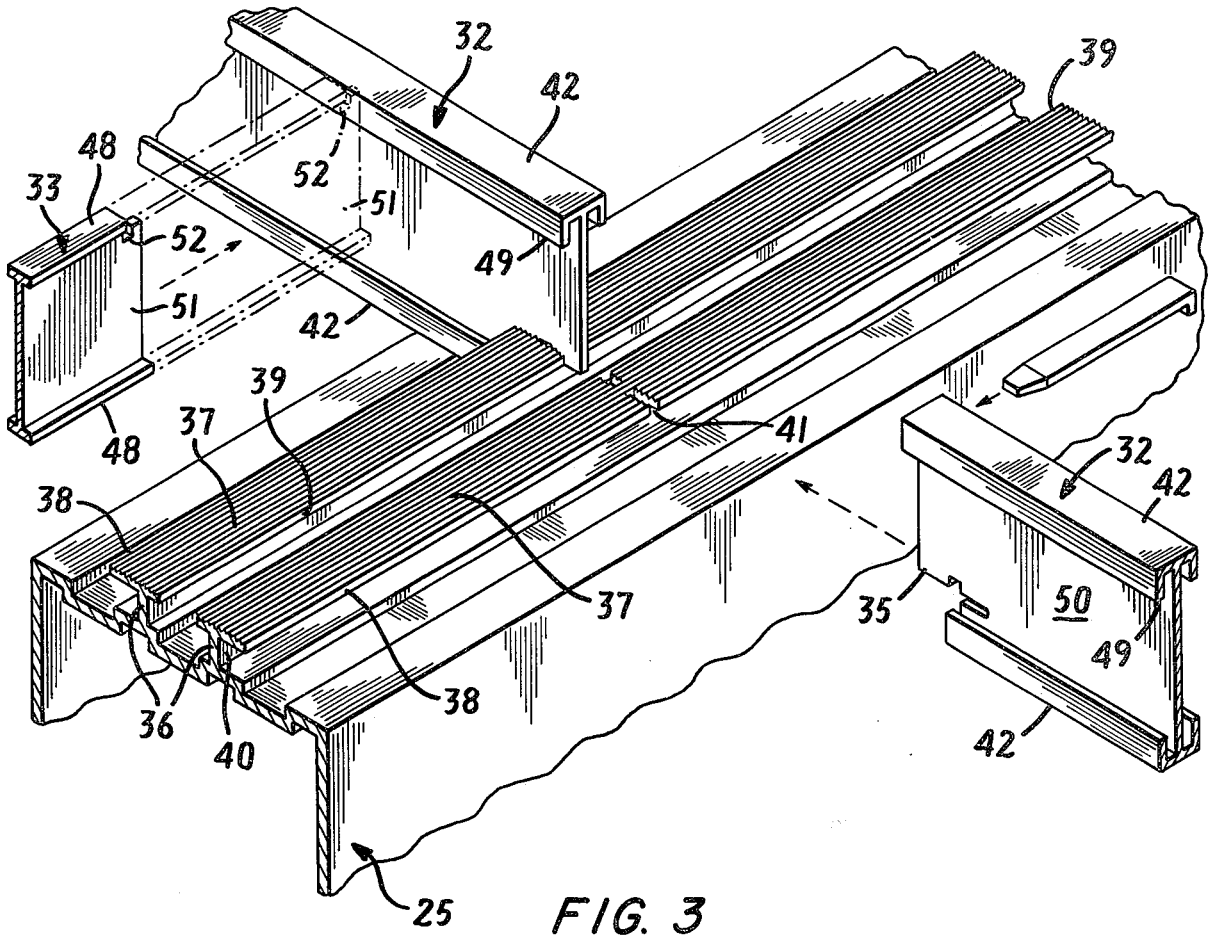
FIG. 3 is a detailed view of the gridwork portion of FIG. 2 enscribed by lines 3—3, showing the interlocking load-supporting purlins of the purlin gridwork supported on box beam supports.

It will be seen from FIG. 3 that each box beam 25 has on its top surface two longitudinally-extending flanges 36, provided with laterally extending tops 37. Each top 37 has flanged portions 38, 39 extending laterally from each side of the central web flange support 40.

At spaced intervals corresponding to the spacing of the load-supporting purlins 32 in the gridwork 30, the flanged tops 38, 39 are notched at 41, but the notches 41 do not extend across the central web support 40. The purlins 32 have ends 35 which are shaped to interlock with the notched portions 41 of the flanges 38, 39, as is apparent from FIG. 3. and consequently the load-supporting purlins 32 are firmly interlocked with the box beams 25. Moreover, the ends 35 of the purlins are virtually abutting, so as to provide a continuous top surface, for support of the roofing skins 45, 46.

The purlins 32 in the embodiment shown are in the shape of I-beams, and at the I-tops 42 on each side, the roofing skins 45, 46 can be affixed. In the embodiment shown there are both inner and outer skins attached on each side of the purlins, and the open space 47 therebetween can be stuffed with fiber glass insulation, or other insulating material, if desired.

The skins 45, 46 are made of fiber glass, but any suitable sheet material can be used, whether translucent, transparent, or opaque, as desired, and the sheets can be colored, also. An interesting effect can be obtained by fitting skins of different colors, to form a pattern in the composite assembly of roofing units.

It will be seen in FIG. 3 that the purlin I-beams 32 have flanged tops 42, the peripheral flanges 49 extending longitudinally of and parallel to the webs 50 of the I-beam. The flanges 49 provide suitable interlocking members for the purlin spacers 33, the ends 51 of which are fitted with notches 52 locking beneath the flanges 49 of the load-supporting purlins 32. Thus, the purlin spacers 33 are also interlocked with the load-supporting purlins 32, for greater rigidity and strength in each roofing unit 3.

Figure 2:
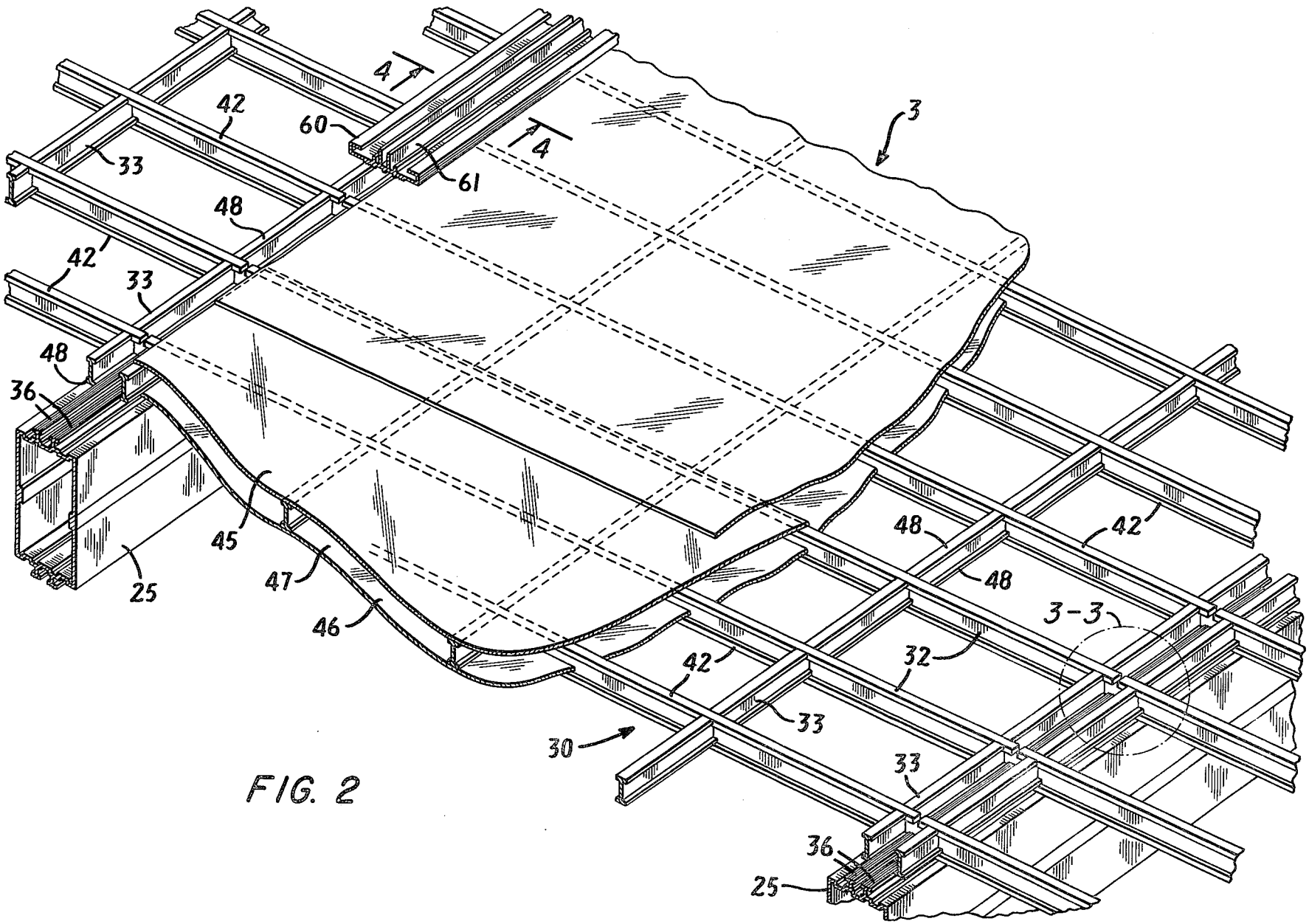
FIG. 2 represents a detailed view of the roof portion enscribed by lines 2—2 of FIG. 1, showing the purlin gridwork in accordance with the invention with a part of the roofing skins removed.

The tops 48 of the purlin spacers 33, which are also of an I-beam configuration, are at the same level as the tops 42 of the load-supporting purlins 32, so that a continuous right-angled gridwork of skin-supporting surfaces is provided at the same level. As seen in FIG. 2, the gridwork is provided with an upper skin 45 and a lower skin 46, in this case both of fiber glass sheet material, completing each roofing unit 3.

It will be seen by reference to FIG. 2 that regular spacing of the notched portions on the flanges of the box beams ensures proper positioning of the rows of load-supporting purlins with respect to each other in the structure.

Figure 4:
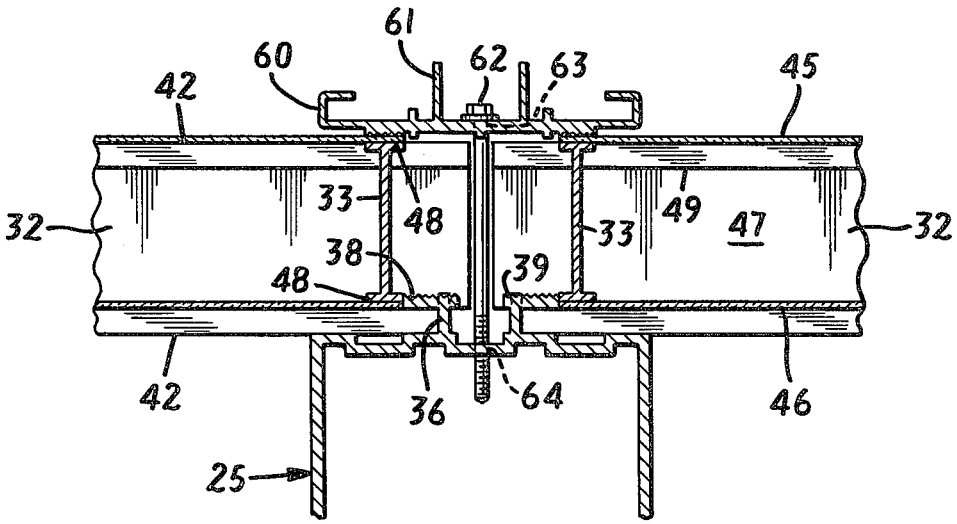
FIG. 4 is a cross-sectional view taken along the line 4—4 of FIG. 2, showing the attachment of load-supporting purlins of the purlin gridwork to a box beam support, with the wheel track affixed to the top of the gridwork.

Along selected box beams a wheel track can be affixed, at the top of the abutting beams of the purlin gridwork, as seen in FIG. 4. The track comprises a U-channel 60, in the central portion of which is disposed an upstanding wheel track 61. At spaced intervals along the track, cap bolts 62 are provided, which pass through apertures 63 in the track, and in the space between abutting beams, to thread into a socket 64 on the top of the box beam supports 25. The bolts 62 can be arranged to have their tops flush with the base of the track, so that the wheel can run along the base of the track without obstruction. A bolt can also serve as a stop, to prevent passage of the wheel further along the track, by having it raised above the base of the track.

FIG. 1 illustrates how the tracks function. In this building structure, the movable roofing units 4 are mounted on wheels 65, which move along six tracks 61. In this way, the movable roof section 4 can be moved up and down, as a unit, between a closed position, at the upper end of the tracks, and an open position, at the lower end of the tracks, as illustrated in FIG. 1. Movement of the roofing section along the track can be effected by electric motors and a cable system. Toothed cog gear wheels and a meshing cog track can be used, to accommodate motorized movement on steep roof peaks, but for most purposes wheels or ball-bearings moving on a metal track will give enough adhesion to serve.

While the roofing system of the invention is illustrated in connection with a natatorium, it will of course be appreciated that it can be used in conjunction with any building structure, whether of large or limited open area, for any desired purpose, such as an industrial warehouse, a gymnasium, a racetrack, a basketball court, a tennis court, a jai-alai stadium, and other purposes.

The beam supports as is apparent from the drawings have two flanged sections parallel to each other, relatively closely spaced and extending the length of the beam, as is necessary for attachment to the roofing units. The beams illustrated are box beams, but of course I-beams, H-beams, T-beams and girders can also be provided with flanged sections at their tops, and can be used. The web portion of the beam can be solid, as in beams, or open, as in girders. All are generically encompassed by the term "beam supports."

The flange can have any flanged cross-sectional configuration, provided the flange can retain a load-supporting purlin beam. The flange consequently extends outwardly of the beam. The flange can carry one horizontal portion, i.e. a ⌐ - or ¬ - configuration, or two horizontal portions, as in a ⊤ -configuration, of which the two portions can have the same or different widths and lengths. The flanges themselves can be attached to or formed in the surface of the beams. The flanges can also terminate in flange-web-parallel portions, i.e. ⌐ , ¬ or ⊤ -.

Modular box beams can, for example, be extruded of aluminum, with continuous flanges extending longitudinally therealong in a ⌐ -, ⊤ - or ¬- configuration. Slots can be cut through the rows of flanges at selected intervals, wide enough to receive the ends of load-supporting purlins of the array. A press fit in the slot with the purlin is especially advantageous, for a rigid structure.

The flanged beams can receive any of a variety of types of interlocking connectors for interlocking with the purlins and for interlocking the purlin spacers and load-supporting purlins. The drawings illustrate a preferred type, using notched purlins and purlin spacers, which attach to the flanges of the box beams and purlins, respectively. It is also possible to provide apertures in the flanges of the beams or purlins, with the notched portion extending through the aperture and hooking to the flange or beam or purlin on the other side. Locking slots and lugs can also be used.

Another convenient type of connector between the beams and the purlins is a pin, passing through an aperture in the purlin or purlin spacer beneath or on the other side of the flange. The purlin, which can, for example, have a flat, I- or T-beam configuration, can be provided with end apertures, at a location such that when in position in the slots and the flanges there is an aperture beneath at least one longitudinally-extending flange of each beam to which it is to be attached. Two apertures can be provided, one on each side of each flange.

The apertures in the purlins can be arranged for attachment of the purlins to the beams at any position along the beams, but they are usually uniformly spaced. The pins lock the ends of the purlins in place on the beams, and because the pins are on opposite sides of the flanges, the purlins cannot be withdrawn.

The pin connectors can be round, triangular, square, or polygonal in cross-section, sized to fit snugly in the apertures in a press fit, and when in position therethrough to lodge securely against the flange and flange web, to prevent sliding movement of the purlins with respect to the box beams, as well as to prevent removal of the purlins from the slots in the flanges on the beams, by lodging beneath the flanges.

It will be apparent that any cross-sectional configuration of purlin and purlin spacer can be used, such as I-beams, T-beams, box beams, and other types of configurations.

The purlin gridwork of the invention can be used to support any type of skin, which can be attached thereto in any convenient manner, for example, using screws, bolts, or an adhesive. The skins can for example be roofing panels, insulation sheets, acoustic panels, lighting shields, and like sheet structures.

The beams, purlins and purlin spacers can be made of metal or of plastic. Since the invention is especially intended for use as and with modular roofing units, extrudable metals are particularly useful, such as, for example, aluminum, aluminum alloys, and titanium alloys, as well as structural steel. Plastics are also well suited for manufacture in extruded or molded shapes, and where they have sufficient strength they can also be employed. Typical useful plastics include polyamides, such as nylon, polycarbonates, polystyrene, phenol-formaldehyde, urea-formaldehyde, melamine-formaldehyde, polyester, polytetrafluoroethylene, and polytrifluorochloroethylene polymers. Plastic-coated metal structures are also useful, particularly where corrosion and weathering are to be inhibited.

Having regard to the foregoing disclosure, the following is claimed as the inventive and patentable embodiments thereof:

1. A large-interior-area building roof structure, comprising, in combination, a plurality of beam supports extending in an array approximately in parallel from one side to the other of the building structure, the beam supports comprising a box beam body having on one side thereof a pair of flanged lugs which extend in parallel longitudinally of the box beam, and have slots therethrough for the ends of load-supporting purlins, and an interlocking modular purlin network supported thereon, the network comprising a plurality of load-supporting I-beam purlins extending in an array approximately in parallel in one direction between the beam supports, and a plurality of I-beam purlin spacers extending in an array approximately in parallel between the load-supporting purlins, the purlin spacers being interlocked with the load-supporting purlins, and the ends of load-supporting purlins being interlocked in the slots of the flanged lugs of the beam supports, thereby locking the purlin network to the box beam roof supports; and roofing skins attached on at least one side of the purlin network.

2. A roof structure according to claim 1, in which the box beam supports are arranged at an angle to the sides of the structure and define a roof peak.

3. A roof structure according to claim 1, in which the roofing skins are attached to both sides of the purlin network.

4. A roof structure according to claim 1, in which the I-beam purlin network supports a track along which moves an I-beam purlin network mounted on wheels which travels along the track.

5. A roof structure according to claim 1, in which the purlin ends engage a connector interlocking the flanged beams with the purlins.

6. A roof structure according to claim 1, in which the purlins and purlin spacers are I-beams having interlocking notched portions in web and foot portions of the I-beams.

7. A roof structure according to claim 1, in which the I-beam purlin spacer ends are notched to interlock with the flanges of the purlin I-beams.

8. A roof structure according to claim 1, in which the box beam supports are made of steel.

* * * * *